United States Patent [19]

Rello

[11] 4,284,364

[45] Aug. 18, 1981

[54] RIBBON TENSIONING FOR A CARTRIDGE WITH FLEXIBLE GUIDES

[75] Inventor: Michael J. Rello, Willow Grove, Pa.

[73] Assignee: Exxon Research & Engineering Co., Florham Park, N.J.

[21] Appl. No.: 13,283

[22] Filed: Feb. 21, 1979

[51] Int. Cl.[3] ..... B41J 32/02; B41J 35/08

[52] U.S. Cl. ..... 400/234; 400/248; 242/75.2; 226/195

[58] Field of Search ..... 226/118, 195; 242/75.2; 400/216, 234, 248

[56] References Cited

U.S. PATENT DOCUMENTS

| | | | |
|---|---|---|---|
| 2,964,157 | 12/1960 | Knight | 400/234 |
| 3,021,989 | 2/1962 | Sellers | 226/118 |
| 3,467,011 | 9/1969 | Phleps et al. | 242/75.2 |
| 3,572,568 | 3/1971 | Lutz et al. | 226/195 |
| 3,758,012 | 9/1973 | Bonner et al. | 400/234 |
| 3,771,704 | 11/1973 | Riedel | 242/75.2 |
| 3,941,231 | 3/1976 | Matuck et al. | 400/248 |
| 3,973,707 | 8/1976 | Pratt, Jr. et al. | 226/118 |
| 4,047,607 | 9/1977 | Willcox | 400/248 |
| 4,047,608 | 9/1977 | Willcox | 400/248 |
| 4,091,913 | 5/1978 | Ku et al. | 400/248 |

FOREIGN PATENT DOCUMENTS

| | | | |
|---|---|---|---|
| 2019648 | 11/1971 | Fed. Rep. of Germany | 400/216 |

OTHER PUBLICATIONS

Arena et al."Ribbon Cartridge . . . " IBM Technical Disclosure Bulletin vol. 10, No. 4, pp. 484–485, 9/67.

Lenney "Ribbon Drag Wire" IBM Technical Disclosure Bulletin, vol. 18, No. 4, p. 1093, 9/75.

*Primary Examiner*—William Pieprz

*Attorney, Agent, or Firm*—Norman L. Norris

[57] ABSTRACT

A stuffed ribbon cartridge for a serial impact printer includes flexible leaders for guiding the ribbon from a stationary storage position to a movable print point. In order to place tension on the ribbon which is stored in the cartridge in a stuffed condition, a clip which pinches the ribbon so as to produce a drag force on the ribbon is located adjacent the print point and spaced from the cartridge by a substantial length of the flexible leader.

12 Claims, 7 Drawing Figures

RIBBON TENSIONING FOR A CARTRIDGE WITH FLEXIBLE GUIDES

BACKGROUND OF THE INVENTION

This invention relates to impact printers and, more particularly, to impact printers where a ribbon moves between a ribbon storage area and a print point to continuously supply fresh ribbon to a position between a character element and a print receiving medium.

Copending applications Ser. Nos. 833,257, filed Sept. 14, 1977 and abandoned in favor of copending application Ser. No. 98,773, filed Nov. 30, 1979, Ser. No. 833,270, filed Sept. 14, 1977, Ser. No. 833,269, filed Sept. 14, 1977, now abandoned and Ser. No. 873,714, filed Jan. 30, 1978, now abandoned disclose ribbon cartridges for impact printers which include flexible leaders or guides which guide the ribbon from the stationary storage area within the cartridge housing to a movable print point. By utilizing the flexible leaders so as to permit the storage area to remain stationary, it is possible to store much larger amounts of ribbon within the cartridge without affecting performance of the printer since the carriage for the printing mechanism need not move the stored ribbon, but merely that portion of the ribbon which is guided to the print point by the flexible leaders. Since a large amount of ribbon may be stored within the cartridge, the operator of the printer is not required to change the cartridge as often and thus avoids the risk of defacing the print receiving medium during replacement of the cartridge, e.g., smearing may be avoided. In addition, the use of a cartridge capable of substantial ribbon storage is more cost-efficient when one considers that the cartridge is, in effect, disposable. In other words, where the capacity for ribbon storage is quite large, the ratio of the cartridge mechanism cost to the ribbon is reduced and the overall cost of the cartridge per strike is decreased.

In the cartridges disclosed in the aforesaid application, the ribbon is stored on reels. The supply reel stores the ribbon prior to passage past the print point and the takeup reel stores the ribbon after passage from the print point. By driving the take-up reel, some control on the tension of the ribbon may be obtained. In this connection, it will be understood that the tension on the ribbon is important, particularly when flexible leaders are utilized, in order to assure that the ribbon remains taut at the print point while at the same time not creating excessive drag on the ribbon through the leaders.

In a stuffed ribbon cartridge, there may be no reels or at most one reel and control on the tension of the ribbon becomes more problematic. If a drag is placed on the supply of ribbon within the cartridge, that drag is magnified through the length of the leaders and can adversely affect the performance of the cartridge. In this regard, it will be understood that it is important that the ribbon move relatively freely through the long flexible leaders between the storage area and the print point for proper operation of the cartridge and the printer.

SUMMARY OF THE INVENTION

It is, therefore, an object of this invention to provide a means by which tension can be placed on the ribbon of a cartridge employing long flexible leaders without affecting the performance or operation of the cartridge.

It is a further object of this invention to supply such a means for creating tension which is adapted for use with cartridges employing long flexible leaders where the ribbon is stuffed in the storage area.

In accordance with these and other objects of the invention, tensioning means are provided which are spaced from the ribbon storage area by a substantial length of the flexible ribbon guide.

The cartridge may include a bridge adapted to support the ribbon at the print point and the tensioning means may be coupled to the bridge. In the preferred embodiment of the invention, the tensioning means comprises pinching means in the form of a removable clip including a finger adapted to rub on the ribbon. The pinching means may include a convex surface adapted to cooperate with the finger so as to pinch the ribbon.

DETAILED DESCRIPTION OF A PREFERRED EMBODIMENT

Figure 1:
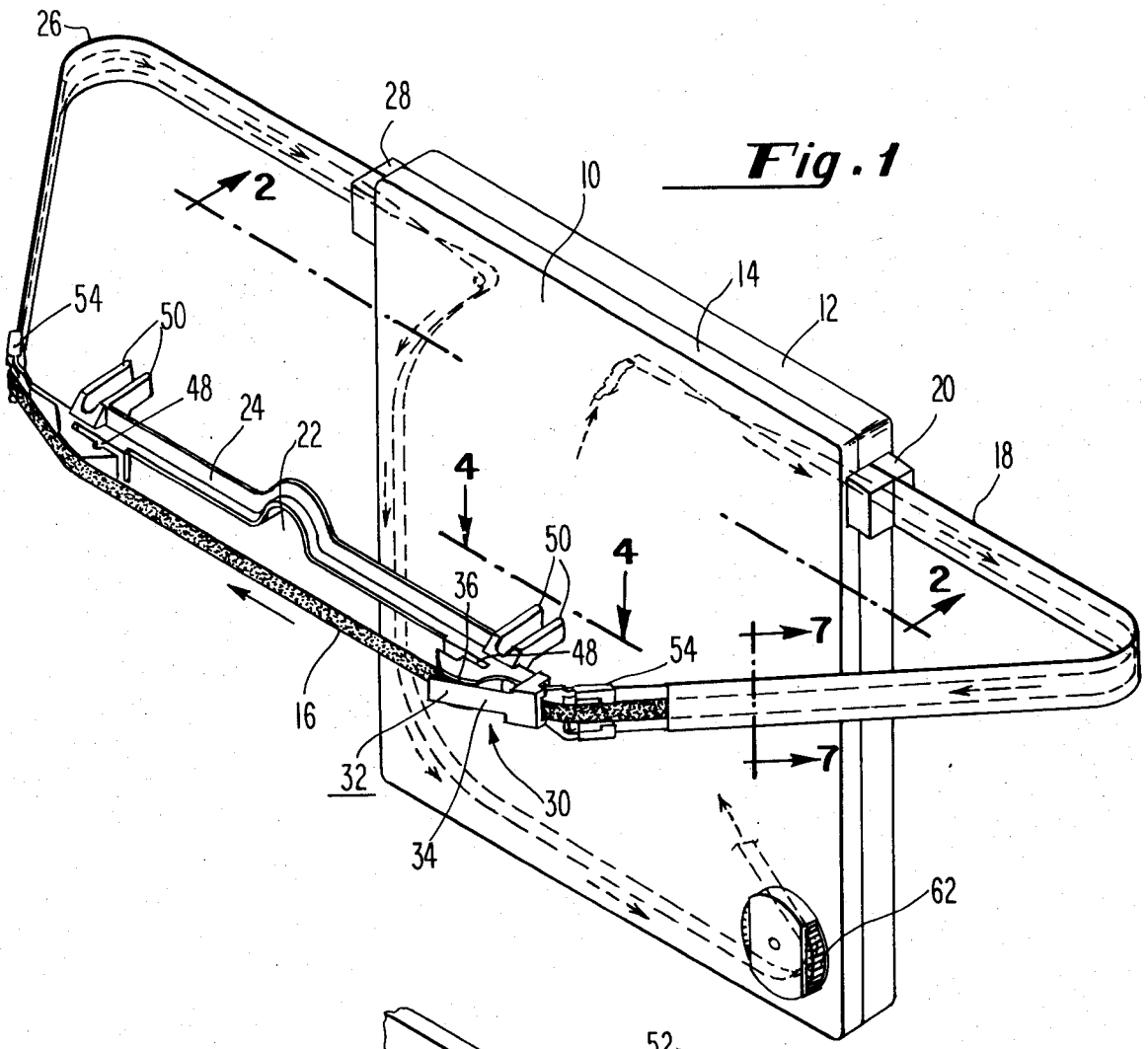
FIG. 1 is a perspective view of a cartridge embodying the invention.

Referring to FIG. 1, a ribbon storage area 10 is formed within a housing 12 which is closed by a cover 14. Ribbon 16 leaves the cartridge through a flexible leader 18 attached to the cartridge at blocks 20 and moves to a print point 22 at the center of a bridge 24. The ribbon 16 is then returned to the cartridge through a flexible leader 26 which is attached to the housing 12 at blocks 28.

In accordance with this invention, tension is maintained on the ribbon 16 by applying a drag force at area 30 which is spaced from housing 12 of the cartridge by a substantial length of the flexible leader 18. More particularly, the drag force which creates the tension is achieved by a removable clip 32 which includes a finger 34 cooperating with a convex surface 36 so as to pinch the ribbon between the surface 36 and the finger 34.

Figure 3:
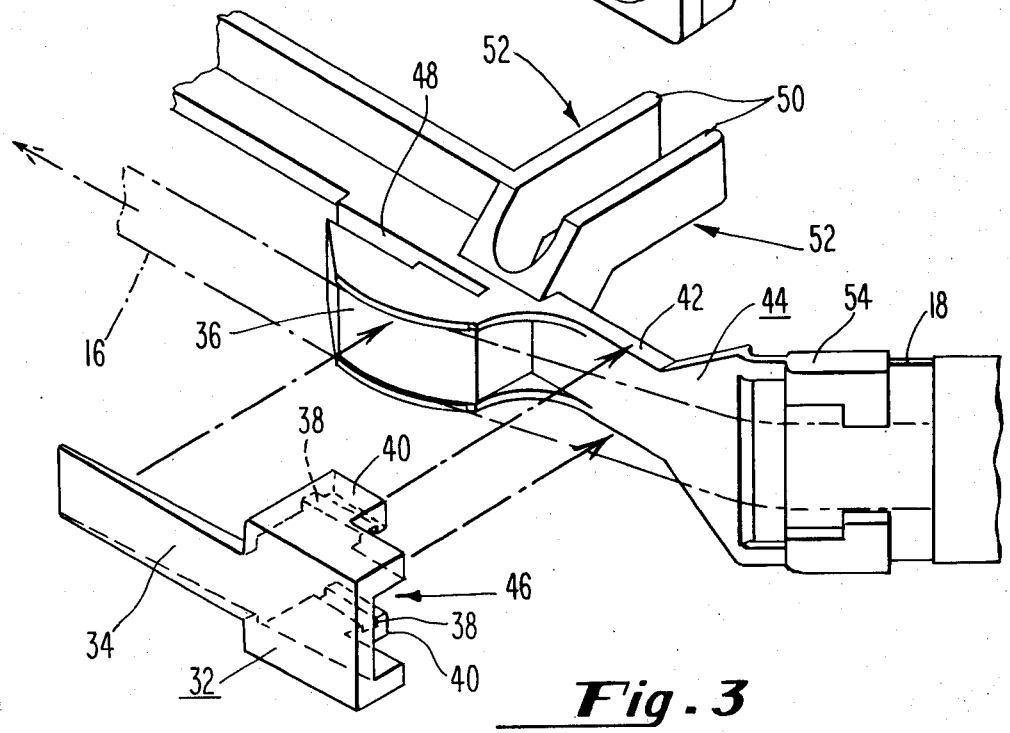
FIG. 3 is an exploded partial view of the elements of FIG. 1 which provide the tension on the ribbon.
Figure 4:
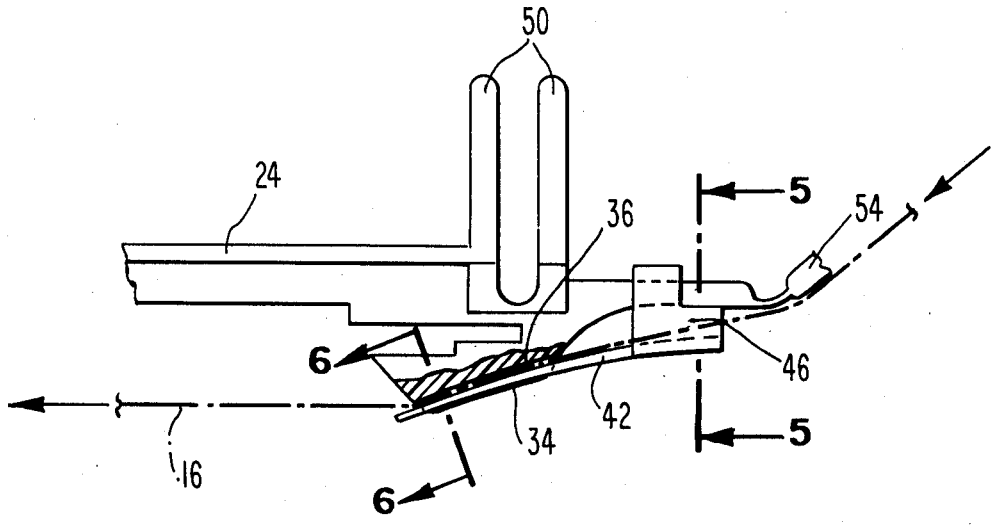
FIG. 4 is a sectional view taken along line 4—4 of FIG. 1.

Referring to FIG. 3, it will be seen that the clip 32 includes opposing grooves 38 and flanges 40 which are adapted to capture the edges of section 42 of supports 44 of the bridge 24. However, a channel 46 as best shown in FIG. 4 is provided so as to permit the ribbon 16 to move between the section 42 and the clip 32 to the area of pinching contact between the finger 34 and the convex surface 36.

As also shown in FIG. 3, the bridge 24 includes support slots 48 which are positioned immediately behind convex surface 36. The slot 48 is open and closed during mounting of the bridge 24 on a printer by pinching arms 50 toward one another as depicted by arrows 52. As shown in FIG. 1, similar arms 50 and a slot 48 are located at the other end of the bridge 24.

As also shown in FIG. 3, the end of the flexible leader 18 is retained by a fastener 54 located at the end of the segment 42. A similar fastener 54 is provided for the other leader 26 as shown in FIG. 1.

Figure 7:
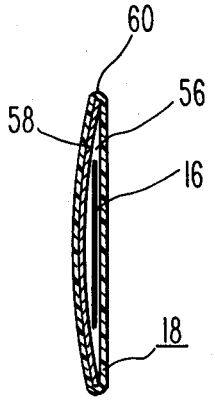
FIG. 7 is a sectional view taken along line 7—7 of FIG. 1.

In order to more fully understand the nature of the drag force applied by the clip 32, reference will now be made to FIGS. 4–7. As shown in FIG. 7, the ribbon 16 moves through a passage 56 of the flexible leader 18 relatively freely, i.e., there is room between the ribbon 16 and the boundaries of the passage 56 which is formed by a cross-curved steel member 58, which is disclosed in detail in the aforesaid application Ser. No. 833,257 which is incorporated herein by reference, and an elastic sleeve 60 which covers the steel 58 but because of the cross-curved nature of the steel 58 leaves the passageway 56. It will, therefore, be appreciated that relatively little drag force is applied to the ribbon 16 by the leader 18 or the leader 26 which is of similar construction.

Figure 5:
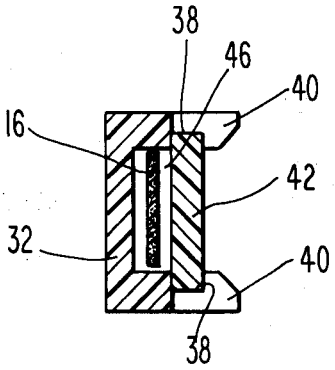
FIG. 5 is a sectional view taken along line 5—5 of FIG. 4.

After the ribbon 16 leaves the leader 18, the ribbon 16 moves through the passageway 46 of the clip 32 as shown in FIG. 5. Here again the ribbon 16 is not restrained, i.e., there is space on both sides of the ribbon 16 within the passageway 46 so as to permit free movement of the ribbon 16 therethrough.

Figure 6:
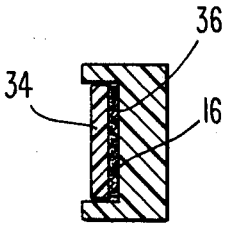
FIG. 6 is a sectional view taken along line 6—6 of FIG. 4.

The ribbon 16 then moves into the region between the finger 34 and the concave surface 36 as shown in FIG. 6. Here, a substantial drag is effected by the pinching between the finger 34 and the surface 36.

Figure 2:
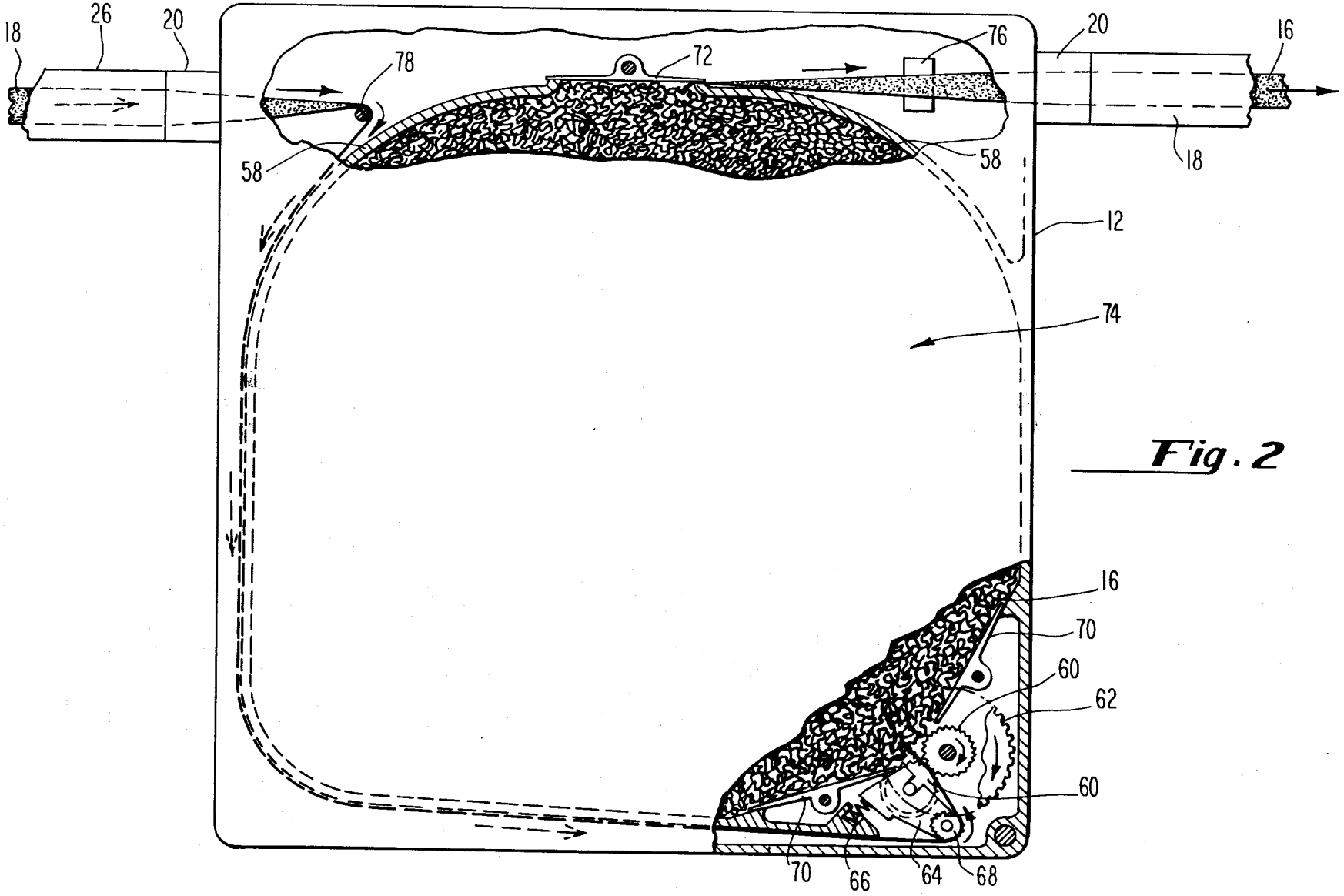
FIG. 2 is a sectional view through the cartridge of FIG. 1 taken along line 2—2.

Reference will now be made to FIG. 2 for a more detailed description of the cartridge housing 12. As shown in FIG. 2, the ribbon 16 is stored within the housing 12 in a stuffed fashion within walls 58. The stuffing is accomplished by means of sprockets 60 which are located in one corner of the housing 12. One of the sprockets 60 is coupled to a gear 62 which is driven by a suitable motor. In order to assure that the sprockets 60 appropriately grip the ribbon 16, the other sprocket 60 is mounted so as to idle in a bracket 64 which is biased toward the other sprocket 60 by a spring 66. An additional sprocket 68 is also mounted on the bracket 64 which guides the ribbon 16 into the space between the sprockets 60. Guides 70 are secured to the housing 12 adjacent the sprockets 60 so as to confine the stuffed ribbon 16 within the housing 12 between the walls 58. A similar guide 72 is provided at the top of the housing 14 where the ribbon 16 emerges from the stuffed storage area 74 and moves toward the leader 18 after undergoing a 90° twist at a guide 76 within the housing 12. A similar twist occurs when the ribbon 16 enters the housing 12 from the leader 26 adjacent a post 78.

Although a specific embodiment of the invention has been shown and described, it will be understood that other embodiments and modifications will occur to those skilled in the art. For example, it may be desirable to utilize the tensioning mechanism of this invention in cartridges which are not of the stuffed type, i.e., such a tensioning mechanism may be utilized in a reel type cartridge. In addition, it will be understood that such a tensioning mechanism is particularly advantageous in connection with a cartridge having flexible leaders for guiding the ribbon to and from a stationary position to a movable print point. In this regard, it will be appreciatd that the specific nature of the flexible leaders may vary. See, for example, the aforesaid copending application Ser. No. 833,257 which is again incorporated herein by reference. See also the aforesaid application Ser. No. 833,270 for a description of a printer incorporating a stationary cartridge which is incorporated herein by reference as well as copending application Ser. No. 61,879 filed July 30, 1979 for its disclosure of a bridge 24 in such a printer which is incorporated herein by reference.

As used herein, the phrase flexible leaders is not limited to leaders of uniform flexibility. By way of example without limitation, a flexible leader need not be uniformly flexible as shown and described in the foregoing specification. The leader could be, for example, articulated and substantially rigid between points of articulation so as to be flexible overall.

Although a specific embodiment of the invention has been shown and described and various modifications suggested, other modifications and embodiments will occur to those skilled in the art which will fall within the true spirit and scope of the invention as set forth in the appended claims.

What is claimed is:

1. A ribbon cartridge for a printer comprising a ribbon storage area, flexible ribbon guide means for guiding said ribbon to and from a print point movable with respect to said storage area and bridge means coupled to said guide means and movable with said print point relative to said storage area for supporting said ribbon at said print point, the improvement comprising tensioning means located on said bridge means.

2. The ribbon cartridge of claim 2 wherein said tensioning means comprises means attached to one end of said bridge means for pinching said ribbon.

3. The ribbon cartridge of claim 2 wherein said pinching means includes a removable clip including a finger adapted to rub on said ribbon.

4. The ribbon cartridge of claim 3 wherein said pinching means further includes a convex surface adapted to cooperate with said finger so as to pinch said ribbon.

5. The ribbon cartridge of claim 1 wherein said tensioning means includes means for pinching said ribbon.

6. The ribbon cartridge of claim 5 wherein said pinching means includes a removable clip including a finger adapted to rub on said ribbon.

7. The ribbon cartridge of claim 6 wherein said pinching means further includes a convex surface adapted to cooperate with said finger so as to pinch said ribbon.

8. A ribbon cartridge for a printer comprising a ribbon storage area, a first flexible ribbon guide leading from said storage area to a print point movable with respect to the ribbon storage area, a second flexible ribbon guide leading from said print point back to said storage area and bridge means extending between said first flexible ribbon guide and said second flexible ribbon guide, the improvement comprising tensioning means located on said bridge means adjacent said print point and movable relative to said ribbon storage area.

9. The ribbon cartridge of claim 1 wherein said tensioning means provides a drag in said ribbon substantially greater than said first guide.

10. The ribbon cartridge of claim 9 wherein said tensioning means is located between said print point and said first guide.

11. The ribbon cartridge of claim 9 wherein said first guide and said second guide are substantially concave in cross-sections so as to provide relatively low drag as compared with said tensioning means.

12. The ribbon cartridge of claim 9 wherein said first guide and said second guide comprise a steel member having a cross-curvature and closure means extending across the curvature so as to form a passageway for said ribbon to pass therethrough.

* * * * *